United States Patent [19]

Shichao et al.

[11] Patent Number: 4,737,683

[45] Date of Patent: Apr. 12, 1988

[54] HIGH LUMINANCE COLOR PICTURE ELEMENT TUBES

[75] Inventors: Shichao Ge; Huang Xi, both of Guangdong; Ruan Shiping, Hangzhou, all of China

[73] Assignees: Hangzhon University, Hangzhon; Shenzhen Electronic Display Devices, Ltd., Guangdong, both of China

[21] Appl. No.: 844,592

[22] Filed: Mar. 27, 1986

[30] Foreign Application Priority Data

Apr. 10, 1985 [CN] China ..... 85102926
May 25, 1985 [CN] China ..... 85104028

[51] Int. Cl.[4] ..... H01J 29/88; H01J 19/57; H01J 19/74; H01J 63/04

[52] U.S. Cl. ..... 313/495; 313/113

[58] Field of Search ..... 313/495, 496, 497, 489, 313/113

[56] References Cited

U.S. PATENT DOCUMENTS 4,352,043 9/1982 Rigden ..... 313/495 X
4,506,191 3/1985 Takenobu ..... 313/495 X

FOREIGN PATENT DOCUMENTS 208057 12/1982 Japan ..... 313/495
158855 9/1983 Japan ..... 313/495
2097181A 10/1982 United Kingdom ..... 313/495

OTHER PUBLICATIONS

Fukushima et al., "A Light-Emitting Tube Array for Giant Colour Display", Displays, (Oct. 1983), pp. 207-211.

A Giant Screen Display of 25×40 m$^2$ (378×1200 Pixels) Capable of Automatically Compensating for the Discrepancy of Pixels and Resisting Ageing, Nikkei Electronics (1984.7.2), pp. 98-101.

*Primary Examiner*—David K. Moore
*Assistant Examiner*—K. Wieder
*Attorney, Agent, or Firm*—Birch, Stewart, Kolasch & Birch

[57] ABSTRACT

The present invention relates to high luminant fluorescent color picture element tubes and display units of the same for large area or giant area display. A fluorescent picture element tube comprises a cathode, a control electrode, an anode, and a light output window. Several such color tubes may be arranged in line or matrix to construct a color picture element tube display unit representing one or more picture elements. The light emitted by the phosphor coated on the large area of the anode passes through the relatively small area of the light output window. A high luminance efficiency may also be obtained as the good heat dissipation of the anode. So higher light output can be obtained and the anode voltage can be reduced.

The cost of large area or giant area display system using the tubes and units which have simple construction and lower drive voltage is greatly reduced. The display of monochrome, polychrome, color, and changeable color is also achievable.

18 Claims, 5 Drawing Sheets

PRIOR ART

HIGH LUMINANCE COLOR PICTURE ELEMENT TUBES

BACKGROUND OF THE INVENTION

The present invention relates to fluorescent picture element tubes with high luminance, more particularly to high luminance color picture element tubes and display units constituted by the same for large area or giant area display panels.

In conventional case, especially in outdoor case, of employing large area or giant area displays, it is usually required that a display device have a luminance of several thousand candelas per square meter because of rather intensive ambient illumination, and it is impossible to offer a sufficiently large display area and high luminance by using a single display device because the display area is often several square meters or more. Therefore, a plurality of luminous picture element components have been used to constitute a display panel, and each of them represents a pixel in the picture displayed on the panel. By means of the circuits electrically connected with each of the picture element components, the instantaneous luminance given by each picture element component corresponds to that of the corresponding picture pixel, so that the picture is contituted on the display panel. Since the luminance and the total light output all over the panel surface are directly determined by the luminance of picture element components, the primary problem to be solved. is to increase the luminance of each picture element component for the purpose of applying the display panel in outdoor case.

In the prior art, incandescent lamps have been used as the picture element components. Since the maximum luminance of the incandescent lamp can be effected by selecting the maximum rated electrical power thereof, the luminance problem of the picture element components is able to be solved. Now this mode is still frequently used for high luminance character displays outdoors. However, the incadescent lamp has the disadvantages of high power consumption, low efficiency, slow response, and low reliability; also the fact that all of the power passes through the control circuit makes it expensive to construct the circuit. Therefore, the Flood Beam CRT (FBT) was invented in Japan a few years ago (disclosed in "Displays" a October, 1983, pp 207–211).

The FBT is an approximate 1-inch diameter CRT without any deflection system, including an electron gun and a phosphor screen emitting light at its one end. One FBT represents one pixel, and tens or even hundreds of thousands such FBTs, whose quantity used depends on the requirements of panel size and resolution and other factors, are arrayed in accordance with a certain mode to construct the large or giant picture or character display panel. The application of the FBT overcomes the defect of the dot-point matrix display panel constituted by incandescent lamps to a certain degree. Furthermore, since each pixel may comprise three monocolor FBTs, according to the instantaneous color and luminance of the pixel, the corresponding monocolor FBT instantaneously illuminates to well effect the color reproduction and to make the color display all over the panel possible. The quality and luminance of the picture can also meet the requirements of application.

However, because each FBT is a small picture tube in itself, the cost may be too high for the giant display system which requires tens or even hundreds of thousands FBTs. Moreover, in order to obtain the required luminance, the high voltage applied to the FBT is as high as 8 to 10kV, this gives rise to a series of problems, such as unreasonably high technical specifications, difficulty of delivering high voltage, and high cost caused by the high voltage circuit. In particular, in the case of outdoor operation, during rainy days or wet season, the humid atmosphere causes difficulty for high voltage isolation and even high voltage accidents. The application of high voltage also makes trouble in maintenance.

It is an object of the present invention to provide a fluorescent picture element tube with high luminance, which is used for large area or gaint area display and capable of operating at low voltage and offering sufficiently high luminance.

It is another object of the present invention to provide a fluorescent color picture element tube with high luminance, which is capable of operating at low voltage and emitting light including three primary-colors of red, green and blue. Each picture element tube becomes a color pixel.

It is a further object of the present invention to provide a fluorescent color picture element display unit which is constituted by a plurality of picture element tubes or tubes arrayed in line or in an mxn (m n are positive integers, and $mxn \geqq 2$) matrix, and represents one or more color pixels.

SUMMARY OF THE INVENTION

According to the present invention, a fluorescent picture element tube comprises an evacuated envelope having a light output window, a cathode, a control electrode, an anode, electrical lead-out means for these electrodes, a layer of phosphor material coated on the anode surface, and light reflection means.

Under the control of the voltage applied to the control electrode, electrons emitted from the cathode strike the anode and make the phosphor illuminate. The light produced passes through the light output window via reflecting from the light reflection means. Since the anode extends along the inner surface of the envelope for a certain distance, and hence the area of the anode is much larger than that of the light output window, so the luminous flux passing through the light output window will be greater than that radiating from a tube in which only the light output window itself is coated with phosphor. The luminous portion in the conventional CRT or FBT is located at one end of the tube, and the area of the luminous portion equals the area of the light output window which is generally rather small. A high luminance efficiency may also be obtained as the large area of the anode. Therefore, the picture element tube fabricated according to the present invention is able to give out higher luminance from the light output window, so that it can operate at lower voltage, and still quite compare with the FBT in luminance. Besides, light passing the output window of the tube could directly be seen by viewers without being influenced by the phosphor coated on the output window.

If the anode, which extends along the inner surface of the envelope and coated with phosphor, is divided into several portions (e.g. three portions), and coated with phosphors having different colors (e.g. three primary-colors), then each picture element tube will become a color display pixel. The instantaneous luminance of these luminous portions are changed by changing the voltages applying to respective anode portions or control electrode in accordance with the instantaneous color requirement for the picture to be displayed, thus completing the color display of the whole panel.

A picture element display unit may be obtained by positioning foregoing mxn picture element tubes on a substrate in a form of matrix. These picture element tubes may either have same color for constituting a monocolor display, or have three different primary-colors for constituting a color or polychrome display. The whole display unit is composed of several substrates which each may have a plurality of color display pixels which each are constituted by a certain number of picture element tubes.

The output of the luminous flux of the picture element tubes described above increases, so does the heat sink area of the luminous portion correspondingly. Besides, the envelope may be made of thin glass of high heat conductivity, and the anode directly attached to the inner surface of the envelope whose outer surface may have a heat sink attached to it, so that the effect of heat dissipation may be improved, thus the phosphor working in this condition may have its luminance efficiency raised. If the envelope is made of metal, better heat dissipation, and hence a higher luminance efficiency will be obtained. In the case of providing the luminance approximately corresponding to that of the FBT, the picture element tube according to the present invention can have an anode whose operating voltage is much lower than FBT's.

Owing to the low operating voltage, the power supply mode and circuitry can be considerably simplified, thus substantially reducing the cost. Every picture element tube need not take the high voltage insulation into consideration, and as a result, the structure and manufacture process of the tube can also be simplified, whereby the cost of manufacturing the picture element tube itself is greatly reduced.

Perhaps the more important thing is that the picture element tubes will have their reliabilities improved obviously due to their low operating voltages, especially in the case of outdoor use, during rainy days or wet seasons. The problems like high voltage accidents will be eliminated, and the picture displayed may have a stable and reliable quality. Because of the larger heat sink area of the picture element tube, the environment ventilation requirement will not be critical. Hence, it is suitable to use the picture element tubes of the present invention as picture element components in large area or giant area display, such as picture and alphanumerics displays at sports grounds, large area displays for traffic control, etc. The further application is the display of alphanumerical character segments which each may include a picture element tube or a display unit. The application of color picture element tubes makes the giant area color display possible which comprises the display of color TV pictures in addition to the displays of alphanumerics, characters, tables, and curves.

DESCRIPTION OF PREFERRED EMBODIMENTS

Figure 1:
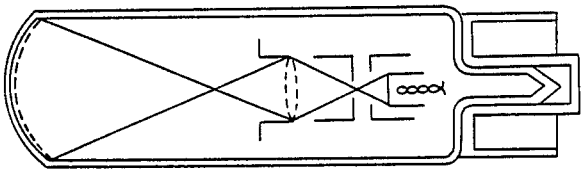
FIG. 1 is a structural view showing the flood Beam CRT in the prior art.
Figure 2A:
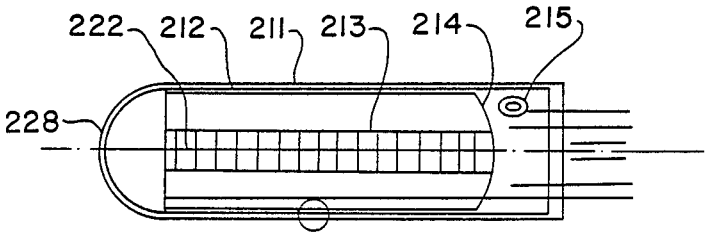
FIG. 2A shows a cylindrical picture element tube obtained from an embodiment according to the present invention.
Figure 2B:
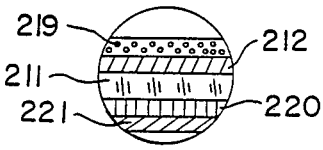
FIG. 2B is an enlarged section of the portion located within the circle shown in FIG 2A.

FIG. 2A shows the structure of a picture element tube produced according to the basic idea of the present invention. In FIGS. 2A and 2B, the picture element tube comprises an envelope 211 made of thin and cylindrical glass, a cathode 222 which is a directly heated cathode located on the axis of the envelope 211, and anode 212 which is made of an electrocally conductive transparent film coated on the inner surface of the envelope 211, a layer of phosphor 219 coated on the anode surface, a control electrode 213 which is a helix grid having the same axis as the cathode and located between the cathode 222 and the anode 212, a light output window 228 located at one terminal of the cylindrical envelope 211, a layer of light reflection film 220 which may be an aluminum film and is coated on the outer surface of the envelope 211 where its inner surface has the anode 212 attached to it, a light reflection means 214 having a concave spherical surface located at the opposite side of the light output window 228, and a black layer of heat radiation material 221 coated on the outer surface of the reflection film 220.

When the phophor 219 coated on the anode 212 is struck by the electrons, which are emitted from the cathode 222 and controlled by the control electrode 213, the light emitted by the phosphor 219 passes through the light output window 228 after reflecting by the phosphor layer 219 and the aluminum film 220 and the light reflection means 214. The magnitude of the light output will now be roughly estimated as follows.

Supposing the length of the luminous portion coated with the phosphor layer to be H, the anode radius to be R, and the luminance of the phosphor to be $B_o$, the luminous flux emitted by the luminous portion is $$F_o = \pi B_o S_o \quad (1)$$

$$= 2\pi^2 RHB_o$$

where $S_o$ is the luminous area of inner surface of the cylindrical anode and is equal to $2\pi$RH. suppose that the light output coefficient K is the ratio of the luminous flux through the light output window to the luminous flux emitted from the luminous portion, the transmittance of the light output window itself is $\rho$, and the effective light output area is S which equals $\pi R^2$, then the luminance of the foregoing picture element tube is $$B = \frac{\rho F_o}{\pi S} \quad (2)$$

$$= 2\rho B_o K \frac{H}{R}$$

$\rho$ depends on the transparency of the light output window, and is larger than 0.8 to 0.9 when there is nothing coated on the light output window. Therefore, K is related to the relectivity and the value of H/R, and increases with the increase of the value of H/R. K tends to saturate after H/R increases to a certain value, thus the value of H/R must be selected reasonable. Under the condition of the cylindrical picture element tube, it is usual to set H/R at from 0.3 to 0.4, and K at from 0.6 to 0.7. substituting $\rho=0.8$, $K=0.6$, and $H/R=3$ into equation (2). B will be $2.88B_o$ close to the actual value. Thus, in spite of the limited value of the effective light output area, the total light output will increase due to increase of the luminous area.

When the anode 212 made of electrically conductive high reflection material, e.g. aluminum, the corresponding light reflection film coated on the outer surface of the glass envelope can be cancelled, and replaced by a heat sink, e.g. a black layer of heat radiation material 221 painted.

Figure 3A:
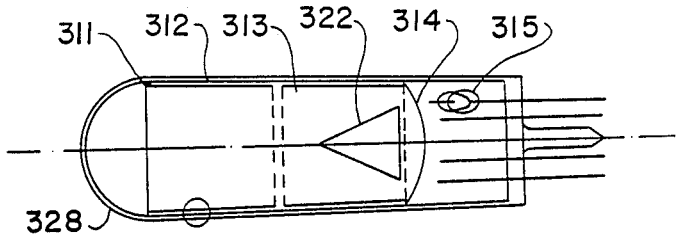
FIG. 3A shows a picture element tube having a cylindrical control electrode obtained from an embodiment according to the present invention.

FIG. 3A shows a picture element tube according to an embodiment of the present invention. Its envelope 311 is a cylindrical thin glass envelope whose one terminal is the light output window 328. The cathode 322 is the directly heated cathode consisting of a few filaments symmetrically disposed about the axis of the envelope 311. The control electrode 313 is attached on the inner surface of the cylindrical portion of the envelope near the terminal where the cathode is disposed. The anode 312 is attached on the inner surface of the cylindrical portion of the envelope including the light output window far from the cathode. Both anode 312 and control electrode 313 are electrically conductive transparent films, and coated with layers of phosphor 319. The light reflection film 320 is coated on the outer surface of the envelope 311 where its inner surface, except the light output window is coated with anode 312 and control electrode 313. The outer surface of light reflection film 320 is coated with a black layer of heat radiation material 321. In a picture element tube having a structure like this, when the picture element tube is in conductive state, the voltage applied to the control electrode is positive and intercepts electrons, so that the control electrode illuminates and makes a contribution to the total light output. The inner surface of the light output window 328 is also coated with an electrically conductive film and a phosphor layer. As long as the thickness of this phosphor layer is chosen carefully, its transmittance will not be reduced greatly. Since this part of phosphor directly contributes to the total light flux output, the total light output may further increase to about $3B_o$ the loss of light output caused by the reduction of the transmittance has been compensated. Moreover, owing to the scatter effect of this phosphor layer, the light passing through the light output window and radiated from the tube may be fairly uniform. When both the anode 312 and control electrode 313 made of electrically conductive high reflection material, e.g. aluminum, the corresponding light reflection film coated on the outer surface of the glass envelope can be cancelled, and replaced by a heat sink, e.g. a black layer of heat radiation material 321 painted.

A further modification of the present invention is to make the envelope of the picture element tube become a rod-shaped envelope whose light output window is parallel to the longitudinal direction of the envelope. The rod-shaped envelope may have a transverse section of circle, ellipse, or triangle-like shape. The cathode consists of one or more directly heated filaments located in the longitudinal direction of the envelope, and the control electrode is a helix grid located between the cathode and the anode.

Figure 4A:
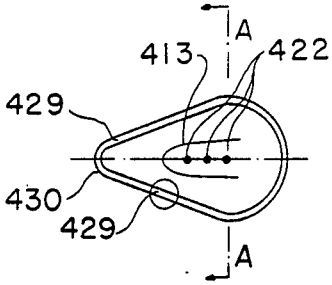
FIG. 4A is transverse sectional view of a picture element tube having a triangle-like cross section, obtained from an embodiment according to the present invention.
Figure 4B:
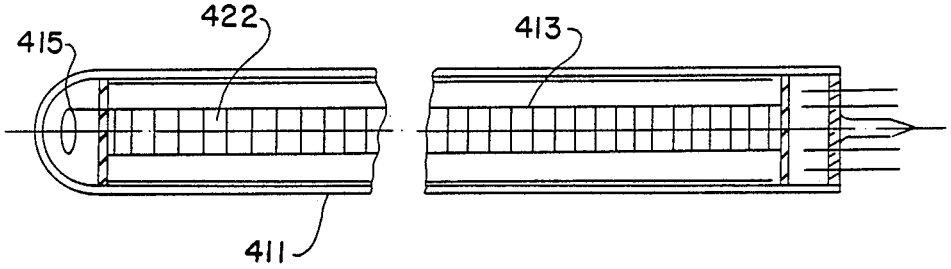
FIG. 4B is a side view taken along the line A—A shown in FIG. 4A.
Figure 4C:
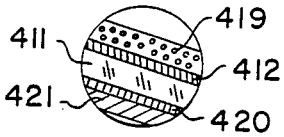
FIG. 4C is an enlarged section of the portion located within the circle shown in FIG. 4A.

FIG. 4A shows a picture element tube having a triangle-like transverse section. The triangle-like envelope 411 is divided, in the longitudinal direction along one side (e.g. line A—A in FIG. 4A) of the triangle, into two parts, one of which having an outward convex wall is the light output window 428, the other having two planar walls 429 with their curved intersection part 430 has an anode 412 attached to the inner surface of the two planar walls and coated with a layer of phosphor 419 thereon. The cathode 422 consists of at least one directly-heated filament located on a plane which divides the tube into two equal parts in the longitudinal direction. The control electrode 413 is located between the anode 412 and cathode 422. The anode 412 may be made of an electrically conductive transparent film. The envelope 411 is made of thin glass, the outer surface of which having the anode 412 on the corresponding inner surface thereof is coated with a layer of light reflection film 420, which may be an aluminum film, whose outer surface is painted with a heat sink such as a black layer of heat radiation material 421.

For a rod-shaped picture element tube whose envelope has a circular transverse section, the envelope is divided, in the longitudinal direction along the diameter of the circle, into two semicircular cylinders, one of which acts as the light output window, the other has anode attached to the inner surface thereof and coated with a layer of phosphor, and has the light reflection layer of aluminum coated on the corresponding outer surface thereof.

For a rod-shaped picture element tube whose envelope has an elliptical transverse section, the envelope is divided in the longitudinal direction along the minor axis of the ellipse, into two semielliptical cylinders, one of which is the light output window, the other has the anode attached to the inner surface thereof and coated with a layer of phosphor, and has the light reflection layer of aluminum coated on the corresponding outer surface thereof.

In the rod-shaped picture element tube whose envelope has a triangle-like transeverse section, the cylindrical surface 428 which is outward convex acts as the light output window, but the effective light output area is the area of the longitudinal section containing the line A—A (see FIG. 4A). Obviously, the luminous area is larger than the effective light output area. When the envelope has a circular transverse section, the effective light output area is equal to the area of the longitudinal section containing the diameter of the circle, but the luminous area is equal to the half area of the cylindrical surface which is larger than the effective light output area. When the envelope has an elliptical transverse section, the effective light output area is equal to the area of the longitudinal section containing the minor axis of the ellipse, but the luminous area is the area of a semielliptical cylinder which is still picture element tubes described above, therefore, all operate in such a way that the light emitted by a large luminous area passes through a small effective light output area, and the heat dissipation is good, thus obtaining higher luminance and reducing anode voltage. Such picture element tubes are especially suitable to be used as alphanumeric segment tubes for displaying alphanumerics.

As the anode of the rod-shaped picture element tube described above is made of an electrically conductive high reflection material such as aluminum, the corresponding light reflection layer coated on the outer surface can be cancelled, and replaced by a heat sink such as a black layer of heat radiation material.

Figure 5A:
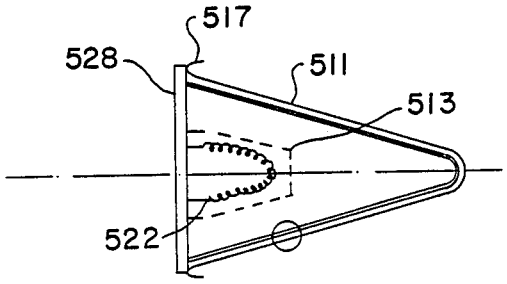
FIG. 5A shows a conical picture element tube obtained from an embodiment according to the present invention.
Figure 5B:
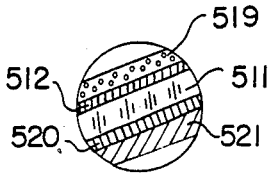
FIG. 5B is an enlarged section of the portion located within the circle shown in Fig. 5A.

Another modification of the present invention is shown in FIG. 5A and 5B. In FIG. 5A, the picture element tube comprises a conical envelope 511 which may be made of thin glass, a glass light output window 528 being the base of the cone and being sealed with the cone, a directly heated cathode 522 located symmetrically about the axis of the envelope 511, and a anode 512 which is made of an electrically conductive transparent coated on the conical inner surface of the envelope 551, a layer of phosphor 519 coated on the anode surface, a control electrode 513 being a metal mesh located between the anode 512 and cathode 522, a layer of light reflection film 520 which may be an aluminum film, and a black layer of the heat radiation material 521 painted on the outside of the aluminum reflection film 520 and used as a heat sink.

When the anode 512 is made of electrically conductive high reflection material such as aluminum, the light reflection aluminum film coated on the outer surface of the conical envelope can be omitted, and replaced by a heat sink attached such as a black layer of heat radiation material painted.

When the conical envelope is made of metal, and used as the anode and the light reflection film concurrently, the inner surface of which is coated with a layer of phosphor.

Since the conical envelope can have more effective light output, i.e. larger light output coefficient, it is not necessary to coat phosphor on the light output window. This leads to a higher transmittance, and hence higher luminance of the picture element tube.

Assume that the raidus of the cone base is R, the length of the cone side is L, then the luminous area $S_o=\pi RL$, the light output area $S=\pi R^2$, and $S_o/S=L/R$. If the luminance on every portion of the luminous area is $B_o$, the output liminous flux through the light output surface in the conical picture element tube will become $$F = \pi B_o S_o K_o \left(1 - \frac{S'}{S}\right) \tag{3}$$

where K is light output coefficoent which equals about 0.9 in the conical picture element tube, S' is the shadow portion, from where no light is emitted owing to the inner structure, and S'/S equals about 0.07. Then the luminance of the conical picture element tube becomes $$\begin{aligned} B &= \frac{F}{\pi S} \\ &= B_o K \frac{S_o}{S}\left(1 - \frac{S'}{S}\right) \end{aligned} \tag{4}$$

Substituting corresponding values into equation (4), we obtain $$B = 0.837\, B_o \frac{S_o}{S} \tag{5}$$

If put L/R to be 4, then $$B=3.35B_o$$

The above estimation shows that in the conical picture element tube according to the present invention the resulting luminate at the light output window is much higher than the luminance at the luminous surface, so higher luminance is available. Under the condition that both the conical picture element tube and the FBT have identical luminance at their light output windows, the anode voltage of the former can be greatly reduced.

After some modifications have been made for the above mentioned embodiments, a fluorescent color or polychrome picture element tube may be obtained. In this tube, the anode is divided into at least two portions which are separated and isolated from each other and coated with phosphors of different colors, and dividing lines between each two portions are on respective planes containing the axis of the picture element tube. By controlling the magnitude of the voltages applied th the control electrode and each anode portion respectively, the instantaneous luminance and color of the total light emitted from the picture element tube can be changed. If the anode is divided into three portions which are coated with red, green, and blue primary-color phosphors respectively, and three anode portions have different areas in accordance with the luminous efficiencies of the phosphors coated thereon respectively, the picture element tube according to this embodiment will be able to reproduce the desired color and to be used for displaying color pictures, for example, TV pictures, as well as polychrome, color, and changable colors alphanumerics, characters, tables, and curves.

As a modifications, by arranging at least two conical picture element tubes shown in FIG. 5A in line or matrix, and fixed with each other, a fluorescent picture element tube display unit may be obtained.

Figure 6A:
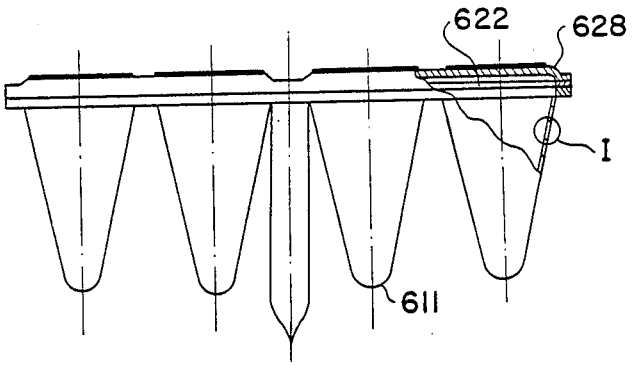
FIG. 6A shows a display unit obtained from an embodiment according to the present invention.
Figure 6B:
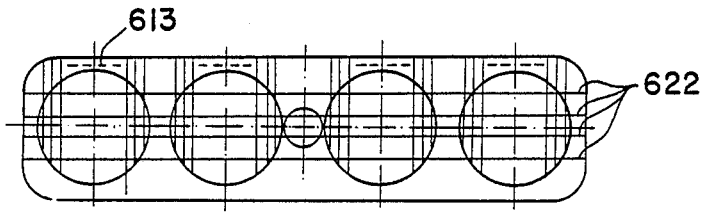
FIG. 6B is a vertical view of the display unit shown in FIG. 6A.
Figure 6C:
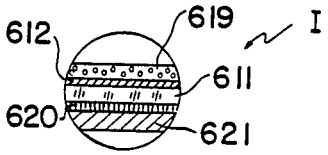
FIG. 6C is an enlarged section of the portion located within the circle shown in Fig. 6A.

FIG. 6A shows a display unit constituted by arranging a plurality of picture element tubes in line. The unit comprises light output windows 628 and envelope array 611 of the conical picture element tubes. These envelopes which inner spaces are connected with each other, are made of thin glass or metal, and sealed with light output windows 628 which are planar glass plates or outward convex glass walls whose inner surfaces face the bases of the conical envelopes respectively. The cathode 622 composed of at least one filament which is common to every tube, is disposed in the longitudinal direction parallel to the bases of the conical envelopes, sealed, and fixed, between the light output windows and the envelope. The anodes 612 which may be electrically conductive transparent films in the case of using thin glass envelopes are coated on the anodes 612 has a layer of phospher 619 coated on its inner surface. Control electrodes 613 made of metal mesh are disposed between the cathode 622 and anodes 619 and led out. The light reflection films 620 such as aluminum films are coated on the outer surfaces of the conical envelopes where the inner surfaces have the anodes 612 attached. The outer surfaces of these aluminum films are painted with black layers of heat radiation material used as heat sink.

When the anodes 612 are made of electrically conductive high reflection material such as aluminum, the light reflection films can be cancelled, but the black layers of heat radiation material showed still remained and are directly coated on the outer surfaces of the envelopes where the light reflection films would have been coated.

When the conical envelope array is made of metal, the inner surfaces are used as the anodes and light reflection films concurrently, and are coated with layers of phosphors 619.

The foregoing display unit constituted by picture element tubes arrayed in line can be used for alphanumeric segment displays, and can be combined according to requirements with advantages of simpler structure and lower cost.

Figure 7A:
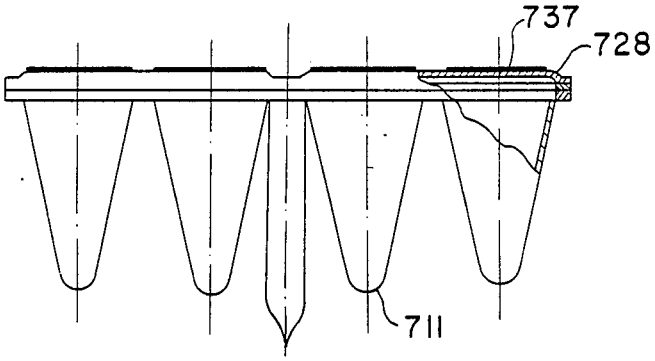
FIG. 7A shows a matrix display unit obtained from an embodiment according to the present invention.
Figure 7B:
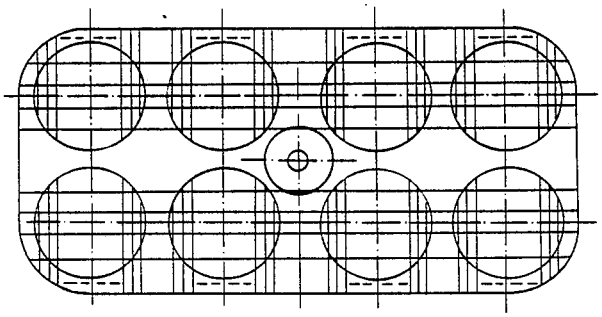
FIG. 7B is a vertical view of the display unit shown in FIG. 7A.

FIG. 7A and 7B illustrate another type of high luminance fluorescent picture element tube display unit which differs from the embodiment of FIG. 6A in that several conical envelopes 711 of picture element tubes constitute an $m \times n$ (m and n are positive integers, and $m \times n \geqq 2$) matrix, say $2 \times 4$ matrix, in which every four picture element tubes are arranged to be a square array representing a color display picture clement. For example, the square array may be composed of two green tubes in one diagonal, and a red tube and a blue one in the other. In some positions of the light output windows 728 where the light leave these conical tubes, light filters 737 corresponding to the respective luminous colors emitted by three primary-color picture element tubes may be disposed in order to improve constitute the large or giant display panels according to the requirement. Since under the control of the control electrodes each color display unit can display the instantaneous color and luminance corresponding to the picture portions to be displayed, this type of color picture element tube display unit may be used to display not only the alphanumerical characters, but also the large or giant area color pictures, such as color TV pictures.

Figure 3B:
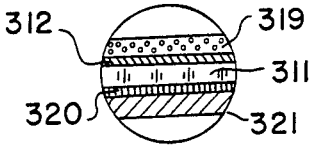
FIG. 3B is an enlarged section of the portion located within the circle shown in Fig. 3A.

The fluorescent picture element tubes and the fluorescent picture element tube display units according to the present invention described above have high vaccum inside the envelopes, in which the oxide cathode can be used. To reach and amintain higher vacuum and to increase the lifetime of these devices, there is a getter in each tube or unit, such as getters 215 and 315 shown in FIGS. 2 and 3 respectively, are provided inside the envelopes. and to adapt to the low anode voltages, the phosphor powders to be used must be able to operate at low voltage.

The present invention is not limited to these embodiments, but various variations and modifications may be made without departing from the spirit and scope of the present invention, for example, the shape and type of cathode and control electrode, and their arrangements in the tubes and units etc.

What is claimed is:

1. A high luminance fluorescent picture element tube comprising:

an evacuated envelope having an inner surface and an outer surface and having a light output window;

a cathode disposed within said envelope;

a control electrode disposed within said envelope;

an anode disposed on a part of said inner surface of said envelope not including said light output window, and coated with phosphor, the area of said part coated with phosphor being much larger than the effective light output area of said light output window;

a light reflection film coated on one of said surfaces of said envelope corresponding to the position of said anode for reflecting the light emitted from said phosphor so that said light can be output from said light output window; and a heat sink attached to said light reflection film.

2. A high luminance fluorescent picture element tube as defined in claim 1, wherein said envelope is a cylindrical thin glass envelope; said light output window is a first terminal; said cathode is a directly heated filament cathode located on the axis of said picture element tube; said control electrode is a helix grid coaxial with said cathode; and a light reflection means having a concave surface is disposed at a second terminal opposite to said light output window for reflecting the light emitted from said phosphor onto said output window.

3. A high luminance fluorescent picture element tube as defined in claim 1, wherein said envelope is a cylindrical thin glass envelope; said light output window is a first terminal; said cathode consists of directly heated filaments symmetrically disposed about the axis of said envelope; said control electrode is an electrically conductive film coated on said inner surface of said cylindrical envelope near a second terminal where said cathode is disposed; said control electrode has an inner surface coated with a layer of phosphor; and light reflection means having a concave surface is disposed at said second terminal opposite to said light output window for reflecting the light emitted from said phosphor onto said output window.

4. A high luminance fluorescent picture element tube as defined in claim 1, wherein said envelope is a rod-shaped thin glass envelope having a longitudinal direction and one long side parallel to the axis of said envelope; said light output window makes up said long side; said cathode consists of at least one directly heated filament located in said longitudinal direction of said envelope; and said control electrode is a helix grid located between said cathode and said anode.

5. A high luminance fluorescent picture element tube as defined in claim 4, wherein said envelope has a circular transverse section and is divided, in said longitudinal directional along the diameter of the circle, into two semicircular cylinders, one of which is said light output window and the other has said anode attached to the inner surface thereof.

6. A high luminance fluorescent picture element tube as defined in claim 4, wherein said envelope has an elliptical transverse section and is divided, in said longitudinal direction along the minor axis of the ellipse, into two semielliptical cylinders, one of which is said light output window and the other has said anode attached to the inner surface thereof.

7. A high luminance fluorescent picture element tube as defined in claim 4, wherein said envelope has a triangle-like transverse section, one of the walls of the triangle rod-shaped envelope being said light window and the other two walls with their curved intersection having said anode attached to the inner surface thereof.

8. A high luminance fluorescent picture element tube as defined in claim 1, wherein said envelope is a conical envelope with a curved top whose base is said light output window; said cathode consists of directly heated filaments symmetrically disposed about the axis of said conical envelope; and said control electrode is a mesh grid disposed between said cathode and said anode.

9. A high luminance fluorescent picture element tube as defined in claim 8, wherein said envelope is a thin metal envelope, the inner surface of which is used as said anode and said light reflection film concurrently, and the outer surface of which has said heat sink attached, said heat sink being a black layer of heat radiation material.

10. A high luminance fluorescent picture element tube as defined in claim 1, wherein said envelope is a thin glass envelope; and said anode is divided into at least two portions which are insulated from each other and coated with phosphors of different colors, respectively, to thereby obtain multi-color display.

11. A high luminance fluorescent picture element tube as defined in claim 1, wherein said envelope is a thin glass envelope; said anode is an electrically conductive transparent film; said light reflection film is coated on the outer surface of said envelope corresponding to the position of said anode; and said light reflection film has said heat sink attached, said heat sink being a black layer of heat radiation material.

12. A high luminance fluorescent picture element tube as defined in claim 1, wherein said anode is an electrically conductive film capable of reflecting light; said anode film and said light reflection film are aluminum films; and said outer surface of said envelope corresponding to the position of said anode has said heat sink attached, said heat sink being a black layer of heat radiation material.

13. A high luminance fluorescent picture element tube display unit comprising:

a plurality of evacuated envelopes of picture element tubes having light output windows, arranged in the form of an array, and sealed with said light output windows thereof;

a cathode disposed between said envelopes and said light output windows;

control electrodes respectively disposed within said envelopes;

anodes disposed on the parts of inner surfaces of said envelopes not including said light output windows, and coated with phosphor, the area of said parts being much larger than the effective light output windows;

light reflecting films coated on envelope surfaces corresponding to the position of said anodes; and heat sinks attached to said light reflection films.

14. A high luminance fluorescent picture element display unit as defined in claim 13, wherein said envelopes are conical envelopes with curved tops, whose bases are said light output windows; said cathode consisting of at least one filament is disposed in a longitudinal direction parallel to said bases of said conical envelopes, and is sealed and fixed between said anodes and said light output windows; and said control electrodes are metal mesh grids disposed between said cathode and said bases of said conical envelopes.

15. A high luminance fluorescent picture element display unit as defined in claim 14, wherein said envelopes are thin glass envelopes; said anodes are electrically conductive transparent films; said light reflection films are aluminum films coated on the outer surfaces of said envelopes corresponding to the positions of said anodes; and the outer surfaces of said reflection films have heat sinks attached, said heat sinks being black layers of heat radiation material.

16. A high luminance fluorescent picture element tube display unit as defined in claim 14, wherein said envelopes are thin glass envelopes; said anodes are electrically conductive films capable of reflecting light, said anode films and said light reflection films are aluminum films; and the outer surfaces of said conical envelope corresponding to the positions of said anodes have heat sinks attached, said heat sinks being black layers of heat radiation material.

17. A high luminance fluorescent picture element tube display unit as defined in claim 14, wherein said envelopes are thin glass envelopes; and each of said anodes are divided into at least two portions which are insulated from each other, and are coated with phosphors of different colors, to thereby obtain multi-color display.

18. A high luminance fluorescent picture element tube display unit as defined in claim 14, wherein said envelopes are thin metal envelopes, the inner surfaces of which are used as said anodes and said light reflection films concurrently, and the outer surfaces of which have said heat sinks attached, said heat sinks being black layers of heat radiation material.

* * * * *